US006295995B1

(12) United States Patent
Ewāka

(10) Patent No.: US 6,295,995 B1
(45) Date of Patent: Oct. 2, 2001

(54) PERMANENTLY COVERED RIGID OR SEMI-RIGID MOUNTING PIECE FOR AN ARTICLE OF FASHION

(75) Inventor: Irene Diane Ewāka, West Chester, PA (US)

(73) Assignee: Irene D. Ewaka, West Chester, PA (US)

( * ) Notice: Subject to any disclaimer, the term of this patent is extended or adjusted under 35 U.S.C. 154(b) by 0 days.

(21) Appl. No.: 09/544,225

(22) Filed: Apr. 7, 2000

(51) Int. Cl.[7] ..... A45D 8/12
(52) U.S. Cl. ..... 132/275
(58) Field of Search ..... 132/275, 278

(56) References Cited

U.S. PATENT DOCUMENTS 3,183,915 * 5/1965 Bolinger ..... 132/275
4,192,944 * 3/1980 Crosley et al. ..... 132/275
4,896,685 * 1/1990 Lawrence ..... 132/278
5,596,998 * 1/1997 Yasuda ..... 132/278
5,697,387 * 12/1997 Hamisco ..... 132/275
5,735,295 * 4/1998 Sammon ..... 132/275
5,857,469 * 1/1999 Sowell ..... 132/275

FOREIGN PATENT DOCUMENTS

449225 * 6/1936 (GB) ..... 132/278

* cited by examiner

*Primary Examiner*—Todd E. Manahan

(57) ABSTRACT

This invention consists of a permanently covered rigid or semi-rigid mounting piece used as an article of fashion worn by a person. The rigid or semi-rigid mounting piece, which can vary in size and shape, is covered by and adhered to one or more pieces of attractive covering material. The covering material can vary in color, texture, pattern and weight thus making it versatile for fashion accessories. The permanently covered rigid or semi-rigid mounting piece can be attached to hair clasps, headbands, jewelry, beltbuckles, handbag latches or wherever a permanently covered rigid or semi-rigid mounting piece is needed. The present invention is inexpensive and easy to make requiring no dies, molds, special materials or machinery. The present invention is versatile because it can quickly adapt to changes in fashion and trends. Embellishments can be added to further the aesthetic appeal and to enhance the user's personality.

4 Claims, 5 Drawing Sheets

PERMANENTLY COVERED RIGID OR SEMI-RIGID MOUNTING PIECE FOR AN ARTICLE OF FASHION

BACKGROUND OF THE INVENTION

This invention relates to a permanently covered rigid or semi-rigid mounting piece, used as an article of fashion worn by a person, that can be attached to hair clasps, headbands, jewelry, belt buckles and handbag clasps or wherever a permanently covered rigid or semi-rigid mounting piece is needed to further enhance the aesthetic appeal of the fashion accessory.

The permanently covered rigid or semi-rigid mounting piece is attached to a hinge and clasp combination to form a hair barrette. In the past and in general, hair barrettes have been used as a means of securing the hair and keeping it in place. Up until the present invention, most mounting pieces for barrettes are fabricated of rigid material such as wood, metal, and plastic having a smooth or textured surface. The following inventions have addressed the enhancement issue of mounting pieces or hair clasps. The invention, U.S. Pat. No. 5,697,387 issued in the name of Hanisco consists of an interchangeable, removable, flexible material cover. The invention, U.S. Pat. No. 5,735,295 issued in the name of Sammon consists of a bobby pin adhered to bunched or gathered fabric. The invention, U.S. Pat. No. 3,183,915 issued in the name of Bolinger consists of a circular ornament and cross bar through which a soft fabric strip can pass through and attach to a hair clip. The invention, U.S. Pat. No. 4,896,685 issued in the name of Lawrence consists of a hair decoration attached to flexible locking elements. The invention, U.S. Pat. No. 5,857,469 issued in the name of Sowell consists of a barrette body supporting a reusable adhesive tape on its upper surface whereby an ornamental appendage is releasably connected. The invention, British Pat. No. 449,225 issued in the name of Wulf consists of a Hair-Curler made of sheet metal having an upper and lower leg and clamping clip. The curler may receive a covering of celluloid, cloth or rubber.

The present invention, unlike these previous inventions that consist of removable covers, fabric attached to or through clasps, and fabric in combination with a leg and clasp, addresses the need for an attractive, permanently covered rigid or semi-rigid mounting piece that is completely free standing and independent in shape and size of that which it is attached to. It can be adapted to and permanently attached to various fasteners for an article of fashion for a continually changing fashion industry.

BRIEF SUMMARY OF THE INVENTION

The invention is a permanently covered rigid or semi-rigid mounting piece used as an article of fashion worn by a person that chill compliment different types and styles of wearing apparel and will compliment the user's personality. The invention can be attached to hair clasps, headbands, jewelry, belt buckles and handbag clasps, or wherever a permanently covered rigid or semi-rigid mounting piece is needed. Unlike most plastic, wood or metal hair barrettes or belt buckles that may require dies, molds, special materials or machinery to produce them this invention requires no special or unusual process. The invention is versatile, easy and inexpensive to manufacture.

DETAILED DESCRIPTION OF THE INVENTION

Figure 1:
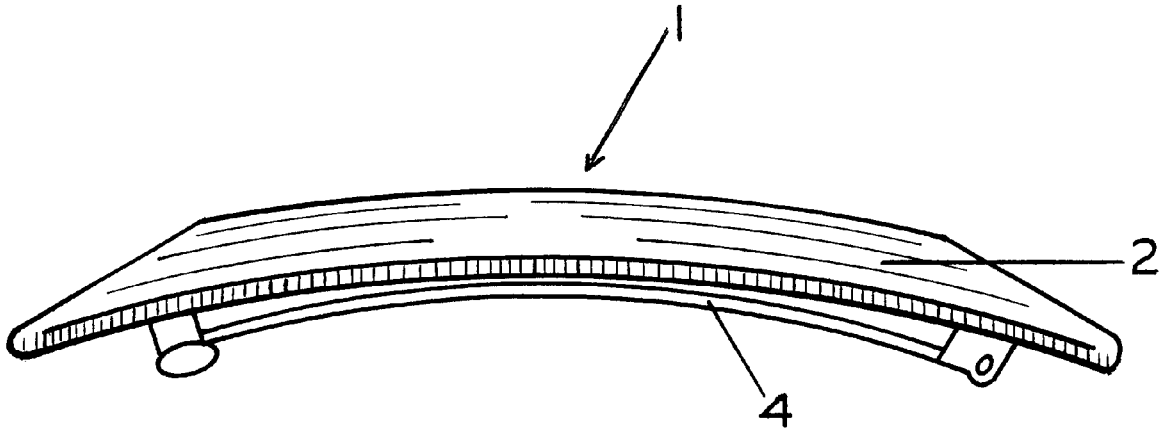
FIG. 1 is a side perspective view of the present invention.

FIG. 1 shows the side perspective view of the present invention a permanently covered rigid or semi-rigid mounting piece 1, covered by the covering material 2, and attached to the clasp and hinge combination 4 to depict a hair barrette.

Figure 2:
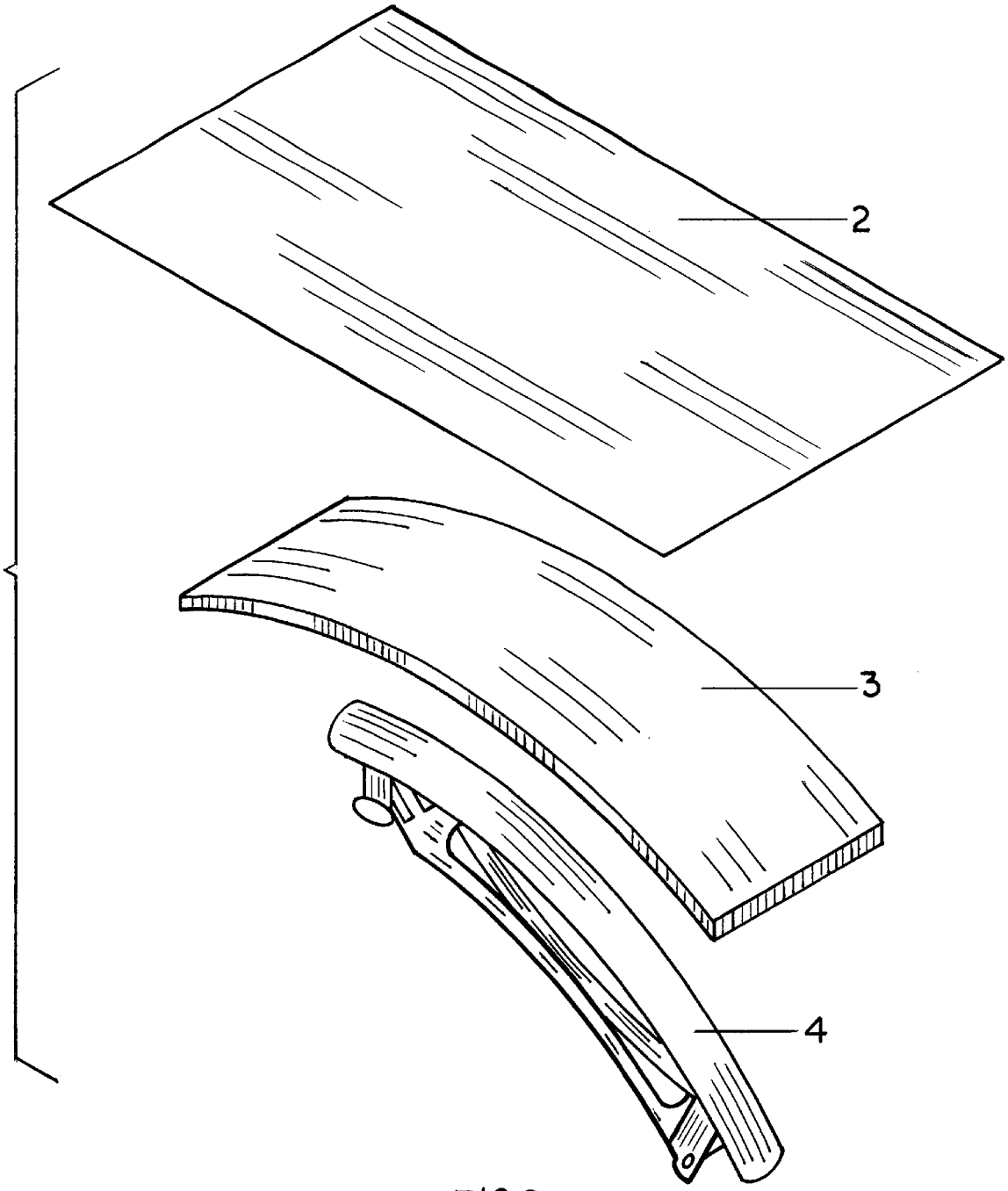
FIG. 2 is an exploded perspective view of the embodiments of the present invention.

FIG. 2 shows an exploded perspective view of the embodiments of the present invention the covering material 2, rigid or semi-rigid mounting piece 3 and the clasp and hinge in combination 4.

Figure 3:
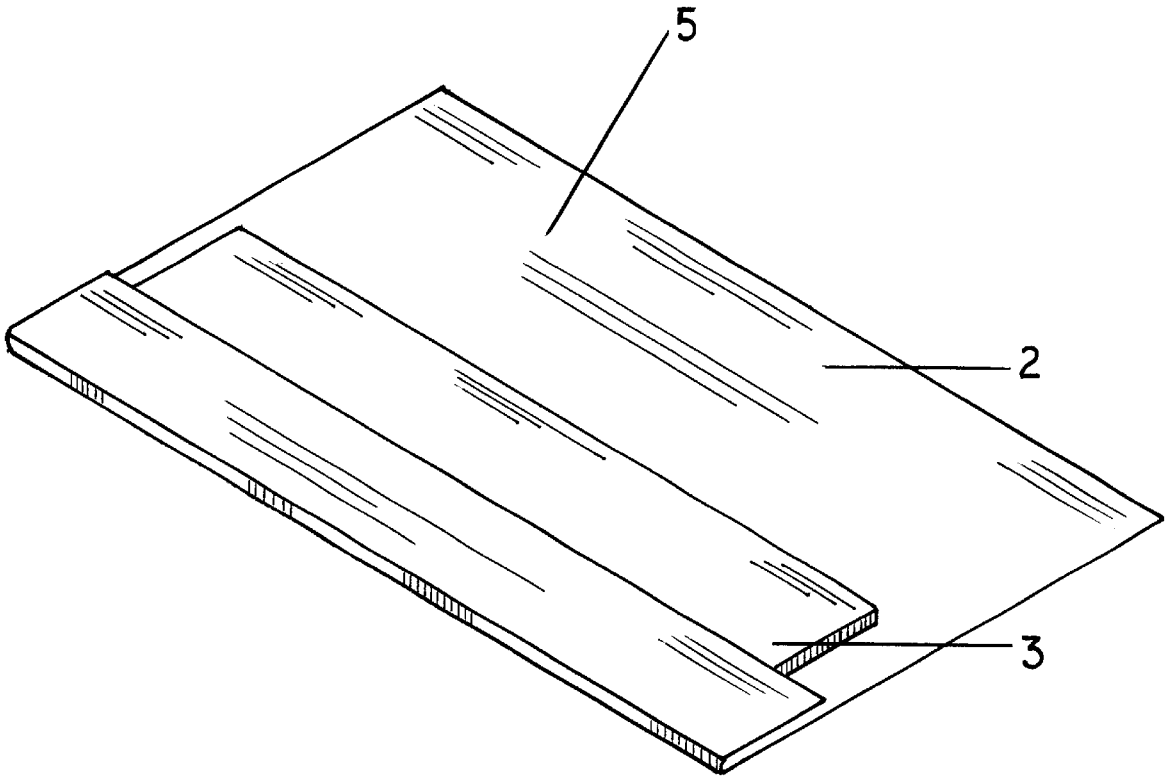
FIG. 3 is a perspective view illustrating the method for applying the covering material to the rigid or semi-rigid mounting piece.
Figure 4:
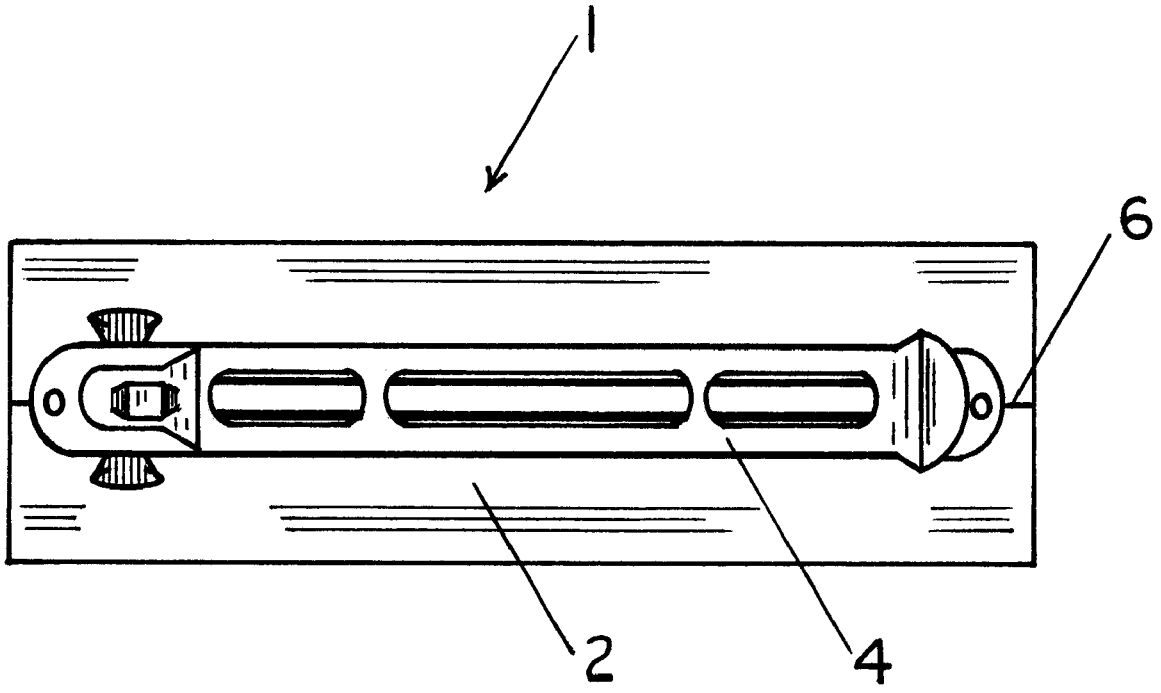
FIG. 4 is a bottom view of the present invention.

FIG. 3 & 4 are in reference to the manufacturing process of the present invention an article of fashion, the covering material 2, combined with adhesive 5 together enwrapping the rigid or semi-rigid mounting piece 3 to the back thereof forming a seam 6 the permanently covered rigid or semi-rigid mounting piece 1 attached to the clasp and hinge 4 in combination to form a hair barrette. The following manufacturing steps have been found to be the easiest and most economical.

1. Choose one or more types of attractive covering material 2.
2. Cut, form or fabricate the covering material 2 slightly larger in size and shape as the cut, formed or fabricated rigid or semi-rigid mounting piece 3.
3. Cover the bottom of the covering material 2 with adhesive 5.
4. At any time during the manufacturing process embellishments 7 (FIG. 5) can be added.
5. Completely enwrap the rigid or semi-rigid mounting piece 3 with the covering material 2 and adhesive 5 in combination.
6. The two longest edges of the covering material 2 meet at the center of the back thereof the rigid or semi-rigid mounting piece 3 thus forming seam 6 (FIG. 4)
7. To achieve a finished appearance excess covering material 2 is trimmed from the rigid or semi-rigid mounting piece 3 thus completing the permanently covered rigid or semi-rigid mounting piece 1.
8. The permanently covered rigid or semi-rigid mounting piece 1 (FIG. 4) is permanently attached to the hinge and clasp combination 4.

Figure 5:
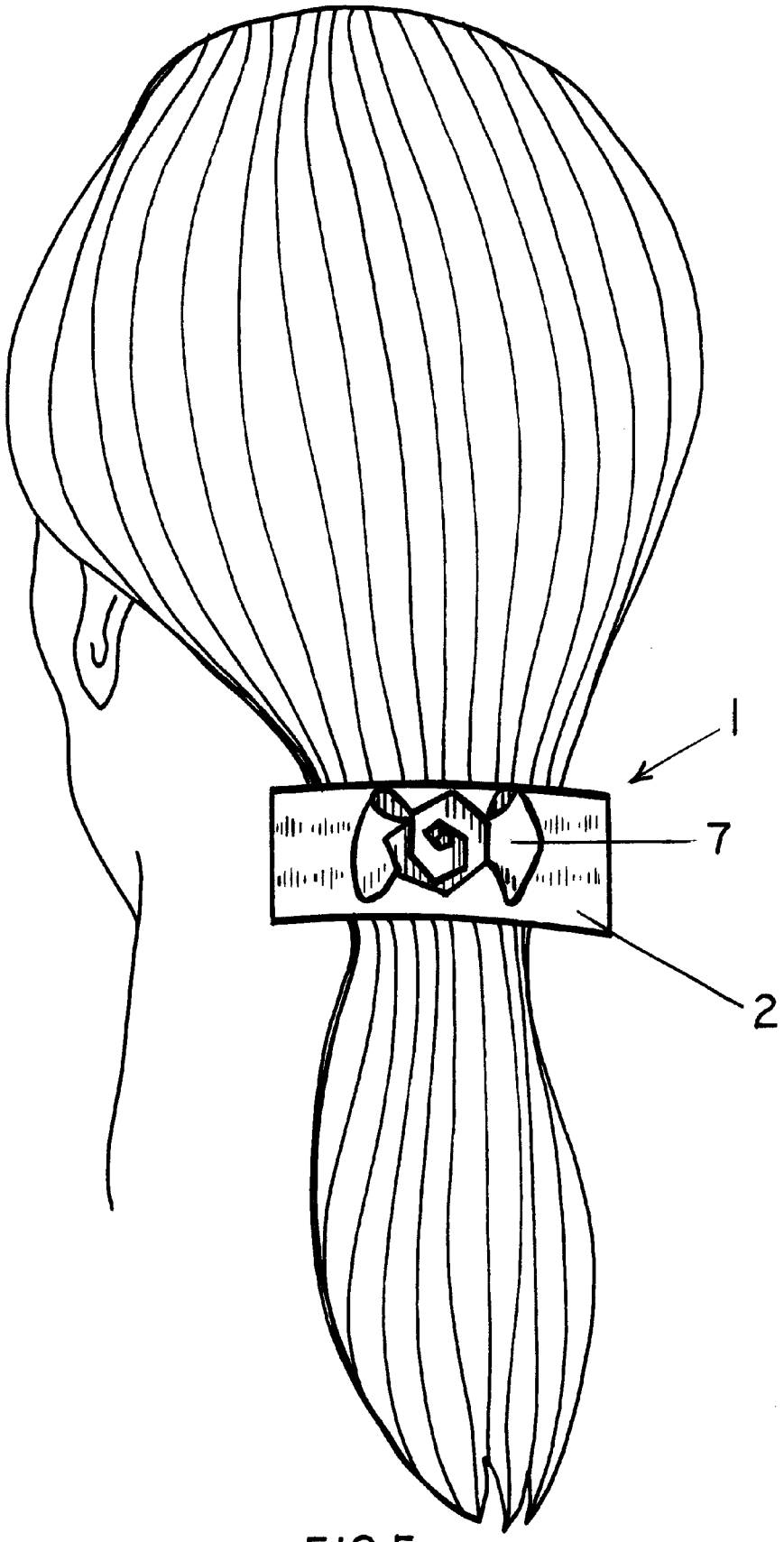
FIG. 5 illustrates a method of use of the present invention

FIG. 5 depicts the present invention a permanently covered rigid or semi-rigid mounting piece 1, with the covering material 2, and embellishments 7 as an article of fashion a hair barrette.

This invention is a fashionably attractive, permanently covered rigid or semi-rigid mounting piece attached to a hinge and clasp combination forming a hair barrette by means of an easy and inexpensive manufacturing process. No special materials are needed for the rigid or semi-rigid mounting piece. Heavy gauge paper such as mat board is suitable. Any attractive covering material with different colors, patterns, textures and weight are appropriate. There is no need for machinery, dies or molds. The invention is versatile. The shape and size of the rigid or semi-rigid mounting piece can be easily changed. The permanently covered rigid or semi-rigid mounting piece can be bent or shaped. the permanently covered rigid or semi-rigid mounting piece can be easily attached to most clasps or fashion components to form a fashion accessory. Also, embellishments can be permanently attached either to the covering material or to the permanently covered rigid or semi-rigid mounting piece to help compliment the changing fashions and trends and to enhance the user's personality.

Various details of this invention consisting of a permanently covered rigid or semi-rigid mounting piece attached to a clasp and hinge combination to form an article of fashion a hair accessory, or hair barrette have been put forth and described in the claims, the description and the best mode for practicing the invention. It should be apparent to those skilled in the art that changes can occur without departing from the spirit and scope of the invention. For example, one might choose to attach the covering material by a mechanical device. The covering material might be partially applied rather then fully applied or the seam can appear in a different location on the rigid or semi-rigid mounting piece. The best method for practicing the invention is for illustration purposes, not to set limitations on the claims. Thus the claims defining the invention are as follows.

What is claimed is:

1. A method of forming a decorative hair fashion accessory comprising the steps of:

(a) providing a mounting piece of a selected size and shape formed or fabricated of a rigid or semi-rigid material, said mounting piece having a top surface and a bottom surface;

(b) selecting one or more types of attractive decorative covering material, the covering material having an inner surface and an outer surface;

(c) cutting the covering material slightly larger in size and shape than the mounting piece;

(d) covering the inner surface of the covering material with an adhesive;

(e) placing the inner surface covering material on the top surface of the mounting piece such that the covering material extends beyond the edges of the mounting piece;

(f) folding covering material which extends beyond the edges of the mounting piece over and against the bottom surface of the mounting piece with the edges of the covering material meeting and forming a seam so as to enwrap the mounting piece;

(g) trimming excess covering material from the mounting piece, if needed, so as to achieve a finished appearance;

(h) providing a hair fastening device having a base and a clasp hingedly attached thereto; and (i) permanently attaching the bottom surface of the mounting piece to the base of the hair fastening device.

2. The method of forming a decorative hair fashion accessory as set forth in claim 1, further comprising the step of attaching one or more decorative embellishments to the top surface of the mounting piece.

3. The method of forming a decorative hair fashion accessory as set forth in claim 2, wherein the one or more decorative embellishments are attached to the top of the mounting piece prior to placing the covering material thereon so as to lie underneath the decorative covering material.

4. The method of forming a decorative hair fashion accessory as set forth in claim 2, wherein the one or more decorative embellishments are attached to the top of the mounting piece after placing the covering material thereon so as to lie on top of the decorative covering material.

* * * * *